United States Patent [19]

Doriath et al.

[11] Patent Number: 4,989,842

[45] Date of Patent: Feb. 5, 1991

[54] DEVICE FOR CHARGING AND DISCHARGING A TILTING SMELTING FURNACE WITH A REMOVABLE CRUCIBLE

[75] Inventors: Jean-Claude Doriath, Eragny sur Oise; Georges M. C. A. Gauje, Saulx les Chartreux; Jacques L. E. Grammagnac, Crisenoy, all of France

[73] Assignee: Societe Nationale d'Etude et de Construction de Moteurs D'Aviation, Evry, France

[21] Appl. No.: 164,812

[22] Filed: Jun. 19, 1980

[30] Foreign Application Priority Data

Jun. 27, 1979 [FR] France ..... 79 16511

[51] Int. Cl.[5] ..... C21B 3/00

[52] U.S. Cl. ..... 266/276; 414/184

[58] Field of Search ..... 266/274, 276; 414/147, 414/160, 172, 180, 182, 184

[56] References Cited

U.S. PATENT DOCUMENTS

| | | | |
|---|---|---|---|
| 1,273,141 | 7/1918 | Brosius | 414/184 |
| 2,388,092 | 10/1945 | Shaub | 414/184 |
| 3,103,286 | 9/1963 | Kodes | 414/184 |
| 3,116,841 | 1/1964 | Kocks | 414/184 |
| 3,870,510 | 3/1975 | Martin | 414/184 |
| 4,215,854 | 8/1980 | Lustenberger | 266/276 |

*Primary Examiner*—Donald P. Walsh

*Attorney, Agent, or Firm*—Bacon & Thomas

[57] ABSTRACT

A device for charging and discharging a tilting melting furnace with a removable crucible, of a type including, in particular, a shovel in the form of a gutter with a circular section in the shape of a segment of a circle designed to introduce a crucible and a compact cylindrical smelting charge into a tilting furnace in the horizontal position, and means for moving the shovel. The inside radius of the cross section of the shovel is at least equal to the radius of the cylindrical charge, and the outside radius is less than the radius of the crucible, and it also includes means for rotating the shovel about its axis.

6 Claims, 2 Drawing Sheets

DEVICE FOR CHARGING AND DISCHARGING A TILTING SMELTING FURNACE WITH A REMOVABLE CRUCIBLE

BACKGROUND OF THE INVENTION

The invention concerns a device for charging and discharging from a tilting smelting furnace, a removable crucible.

More particularly, the device of the invention is designed to place in a furnace a cylindrical crucible containing a compact cylindrical smelting charge, and to extract the crucible. It is suitable in particular when the furnace is part of an installation in which smelting and tapping takes place in a vacuum. The invention also concerns an installation in which smelting and tapping take place in a vacuum equipped with this device.

Already known are installations in which smelting and tapping take place in a vacuum equipped with a device for charging and discharging permitting working through a lock-chamber. The device of the invention belongs to a type comprising:

a charging shovel in the form of a gutter, the cross section of which is in the shape of a segment of a circle, designed, on the one hand, to introduce the crucible and the charge through the lock-chamber into the tilting furnace in the horizontal position, and, on the other hand, to extract the crucible after tapping;

a rectilinear rod, with the shovel attached to its end, the rod and the shovel being approximately coaxial;

means for maintaining the rod horizontally in alignment with the tilting furnace in the horizontal position;

finally, means for moving the rod in travel in the direction of its axis.

In a known device of the type defined above, the radius of the cross section of the shovel is at least equal to the outside semi-diameter of the crucible such that the shovel can accept the crucible, charged or not. The rod is bored and carries in its borehole a rectilinear lever perceptibly longer than the rod, and the device has means for causing this lever to penetrate the shovel by sliding and to momentarily maintain it in a fixed position in space in order to push the charge and the crucible toward the bottom of the furnace during extraction of the shovel, despite the friction this exerts on the crucible.

This device of known type is quite appropriate for its purpose, but at the same time has the following inconvenience, one that is particularly troublesome when the crucible is fragile, and expensive. The crucible is subjected to intense friction during release of the shovel after charging, and during engagement of the shovel prior to extraction of the crucible, and, in addition, the crucible falls a short distance to the floor of the furnace when the shovel is released.

SUMMARY OF THE INVENTION

The principal purpose of the present invention is to avoid the noted inconvenience. The device of the invention, which belongs to the type cited above, is characterized by the fact that the inside radius of the cross section of the shovel is at least equal to the semi-diameter of the charge, and its outside radius is more than equal to the outside semi-diameter of the crucible, and by the fact the aforesaid device includes, in addition, means for imparting to the rod a rotary motion about its axis such that the charge can be placed in the shovel, the charge and the shovel can be capped by the crucible, and, once the shovel, charge, and crucible have been inserted in the furnace, the crucible and the charge can be unloaded without appreciable shock by rotating the shovel and then extracting the latter from the furnace without friction. The crucible is carried virtually throughout the manipulations suspended by its inner wall, by the charge placed in the shovel, or by the back of the shovel, and not by resting on its outer wall.

Advantageously, the device of the invention also includes means for imparting to the rod a vertical movement providing angular clearance about a horizontal axis perpendicular to the aforesaid rod at a distance from the shovel to the rear of the latter such that the shovel can lift the crucible slightly so as to insert it in the furnace without friction, or to extract it without friction.

BRIEF DESCRIPTION OF THE DRAWINGS

Other advantageous arrangements of the device of the invention, and of the vacuum installation it can be used with, will become apparent in the description which follows of an example of a design shown in the attached drawings, in which.

DESCRIPTION OF A PREFERRED EMBODIMENT

Figure 1:
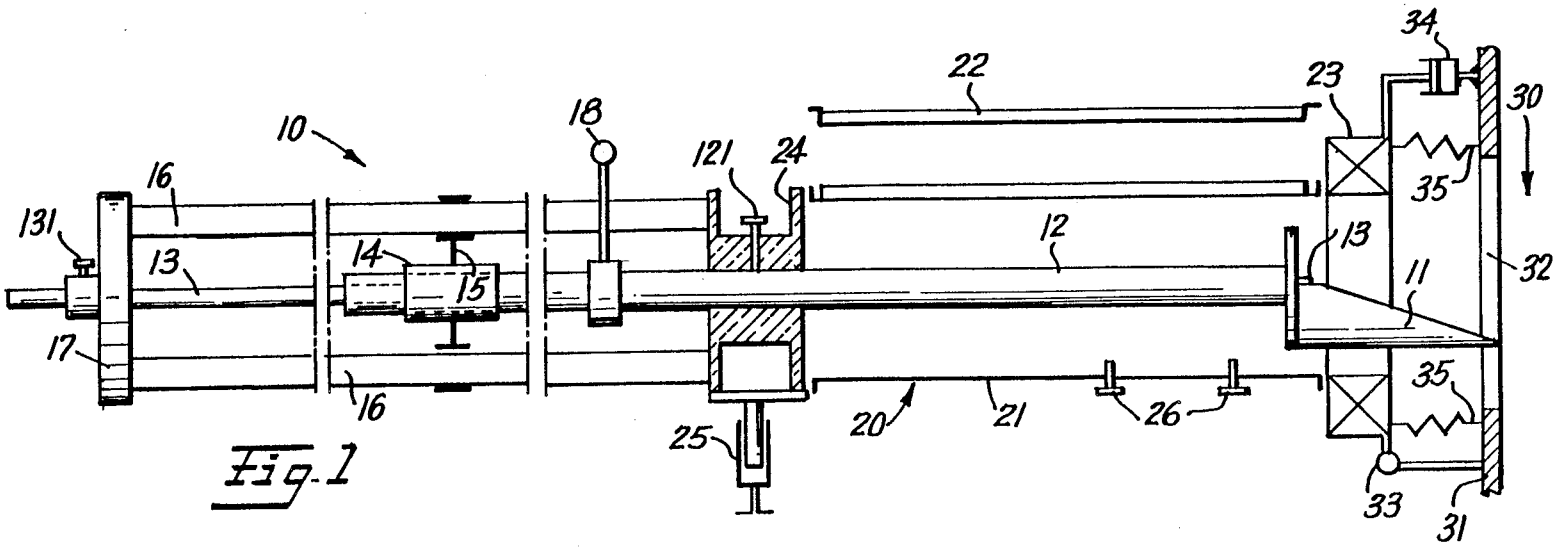
FIG. 1 is a front elevation of a device embodying the invention.
Figure 2:
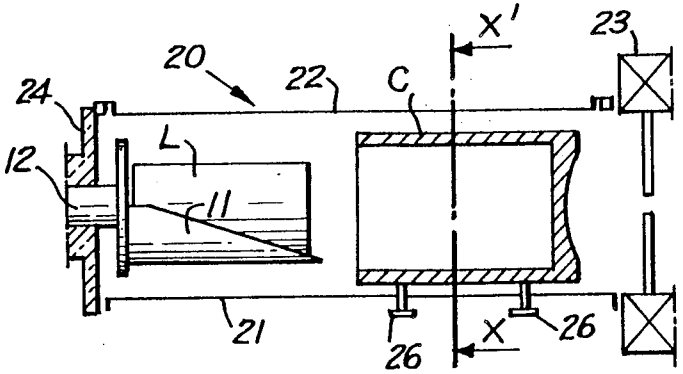
FIG. 2 is a partial front elevation of the same device.
Figure 3:
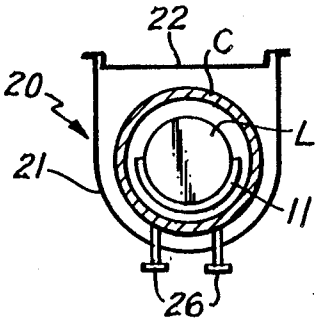
FIG. 3 is a section along the line x—x′ of FIG. 2.

Consider first FIGS. 1, 2 and 3 simultaneously. These are deliberately simplified representations of the device of the invention which do not, with some exceptions, show such accessories as watertight joints, grips, clamps, bolts, lubrication fittings, stops, safety devices, etc., the design of which is within the province of the specialist. This same goal of simplification has resulted in showing the controls as manual, but they can, in fact, be more or less automated.

FIGS. 1, 2 and 3 show, in whole, or in part, the device 10, the shovel of which 11, is always situated in the lock-chamber 20, or in the enclosure, 30, where tapping and smelting in a vacuum take place and which, for the time being, is represented only by a vertical wall, 31, and an access hole, 32.

Shovel 11 is a gutter with a cross section in the form of an arc of a circle. More precisely, it is in the form of a cylindrical ungula. The inside radius of the cross section is at least equal to the semi-diameter of the compact cylindrical tapping charge (an ingot, for example) L, and the outside radius of the aforesaid cross section is less than the inside semi-diameter of crucible C. Shovel 11 is supported by one of the ends of manipulation rod 12, cylindrical and rectilinear. Shovel 11 and rod 12 are coaxial. Rod 12 is bored. A cylindrical lever, 13, appreciably longer than rod 12, can slide in the bore-hole and one of its ends protrudes on the axis of shovel 11.

Lock-chamber 20 comprises:

a lock-chamber housing 21, in the form of a container with a cylindrical bottom, the radius of which is appreciably greater than the outside semi-diameter of crucible C, and long enough to admit crucible C placed in front of shovel 11;

a loading and unloading door 22, shown open in FIG. 1, and closed in FIGS. 2 and 3;

a cut-off gate 23 (a diaphragm gate, for example), ensuring the opening and closing of the passage between lock-chamber housing 21 and enclosure 30; this gate 23, is shown open in FIG. 1, and closed in FIG. 2;

a collar 24 ensuring closure of the end of the lock-chamber opposite enclosure 30, and at the same time acting as a guide for rod 12.

Rod 12 also is guided by a bore-hole in central bushing 14 of carriage 15, itself secured and guided in translation by two parallel cylindrical rails 16. These two rails are secured at their ends, one to the side of collar 24, the other to a flange 17. A bore-hole in this latter carries the end of lever 13 opposite to that protruding into shovel 11. The two rails 16 are, by choice, arranged in the same horizontal plane, although they are shown arranged in the same vertical plane in FIG. 1 to facilitate their representation.

FIG. 1 also shows handle 18 fixed to rod 12 to make it possible to manipulate the shovel 11, by this rod, and two clamps, one symbolized by a clamping screw 121, in collar 24 to hold rod 12 in position, the other symbolized by clamping screw 131 in flange 17 to hold lever 13 in position. Rod 12 and lever 13 thus can be moved, or clamped, independently of each other.

In order to provide for a limited angular deflection of shovel 11 in the vertical plane:

gate 23 is kept in relation to access hole 32 by a horizontal joint, 33, fixed to wall 31, and by means of clamps symbolized by screw-jack 34, and the access between the aforesaid gate 23 and hole 32 is isolated from he exterior space by an expansion coupling 35;

the deflection is controlled by a fitting such as a screw-jack 25, fixed to the floor, or to the base of the furnace.

Fittings 18, 25, 33, 34, 121, and 131 have been deliberately represented in simplified form in order to permit the manipulation and fixing of rod 12 (and thus of shovel 11), and of lever 13. In fact, they can be replaced to advantage by much more complicated fittings that will perform the same functions in a more or less automatic fashion and at the same time perform safety functions.

FIGS. 2 and 3 illustrate in particular the relative positions of shovel 11, charge L, and crucible C in the lockchamber 20, prior to introduction into enclosure 30. Gate 23 is closed, door 22 is closed, charge L is in shovel 11 and crucible C is in front of the charge and the shovel. Crucible C has been centered, for example, by screws 26, screwed tightly into the base of lock-chamber housing 21 With door 22 closed a vacuum is created in the lock-chamber by piping not shown.

As will be seen, when gate 23 is open, the translation of shovel 11 will move the shovel and charge L into the crucible C, which, disengaged from screw 26, will penetrate enclosure 30, suspended at the upper part of charge L.

The figures that follow illustrate certain phases of charging, or of extraction, inside enclosure 30. To be seen, other than the furnace, F (not shown prior to this) of the vacuum smelting and tapping installation, are shovel 11 and the front end of rod 12 and lever 13. Crucible C and charge L also will be found in most of these figures.

Figure 4A:
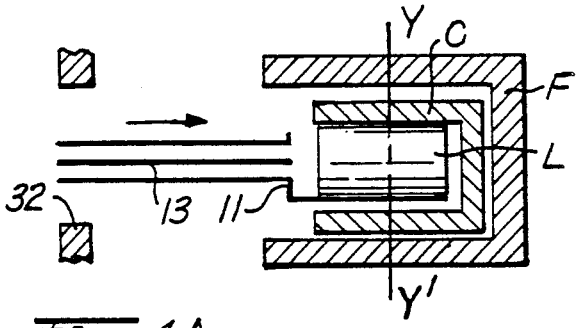
FIGS. 4A, 5A, 6A, and 7A are partial longitudinal schematic sections of a vacuum installation at different phases of operation.
Figure 4B:
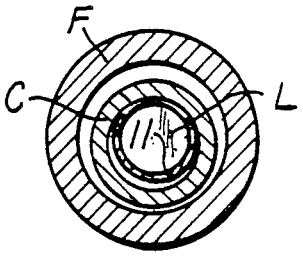
FIGS. 4B, 5B, 6B, and 7B are transverse schematic sections on the line y—y′ in FIGS. 4A, 5A, 6A, and 7A, respectively.

Furnace F obviously is a tilting furnace (resistance or induction) with a removable crucible. It is always shown tilted in the horizontal position, its opening pointed toward the access hole 32. Shovel 11, with its back still oriented toward the base, has been pushed toward the back of the furnace F, in FIGS. 4A and 4B, and still supports charge L, and, as a result, crucible C.

Figure 5A:
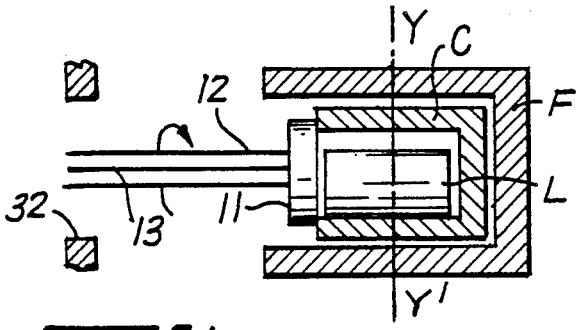
Figure 5B:
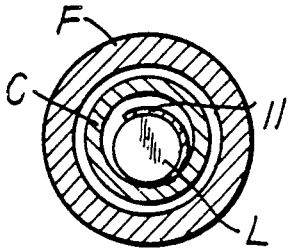

Shovel 11 is being pivoted about its axis in FIGS. 5A and 5B. Charge L is gently deposited against the inside wall of crucible C while the latter remains suspended, no longer on charge L, but on the back of shovel 11.

Figure 6A:
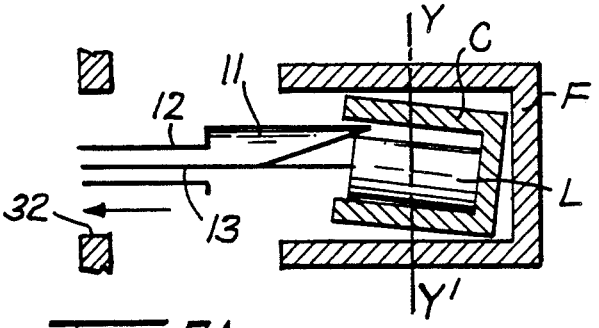
Figure 6B:
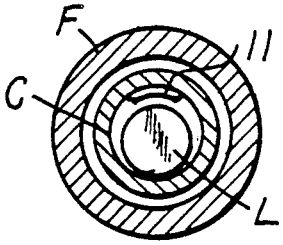

Shovel 11 is being extracted in FIGS. 6A and 6B. Lever 13 has been locked in place by fitting 131 (FIG. 1) and holds charge L and crucible C against the back of furnace F. Shovel 11, back up, is being extracted, and crucible C will remain in furnace F. Because of the contrived clearances between crucible C and furnace F, the crucible will drop a very little bit but the shock is insignificant. It also is possible to tilt the shovel, 11, slightly toward the bottom by means of screw-jack 25 (FIG. 1), so as to deposit the crucible gently in the furnace before the complete extraction of the shovel. Once the latter is extracted from the furnace, gate 23 (FIG. 1) will be closed, the furnace F will be brought to the vertical position, and the smelting operation will begin.

Figure 7A:
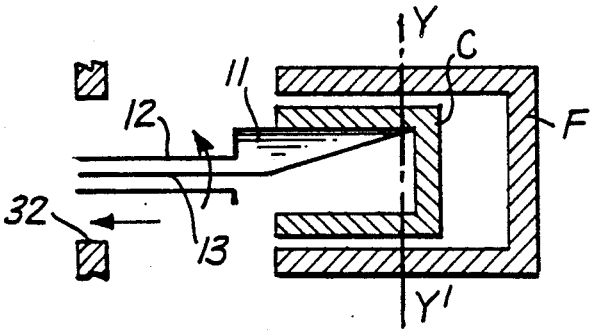
Figure 7B:
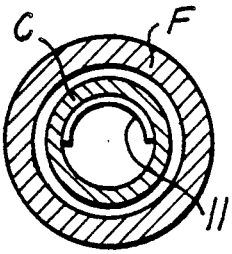

Finally, FIGS. 7A and 7B show how shovel 11 operates to extract a used crucible from furnace F. It is positioned with its back up and given a slight displacement toward the bottom by screw-jack 25, so that it can enter the crucible. It then is given a slight displacement upward to suspend crucible C and to take it away from furnace F. It then can be withdrawn with the crucible through the access hole 32.

The charging device in accordance with the invention will be particularly useful in a controlled hardening installation. In fact, it is known that as of the first tapping the crucible in which the charge was smelted is "passive", and that after this the qualities of the crucible change. Because of the extreme importance of the reproducibility of high-quality parts obtained by the controlled hardening procedure, it often is desirable to make one tap per crucible. Manipulation of a fragile crucible thus becomes of primary importance, and the device of the invention can, as a result, bring about definite savings in time.

We claim:

1. A device for placing a cylindrical crucible with a compact cylindrical smelting charge in a smelting furnace, comprising:

a charging shovel in the form of a gutter the cross section of which is in the shape of an arc of a circle;

a rectilinear rod, with the shovel attached to its end, the rod and the shovel being approximately coaxial;

means for maintaining the rod horizontally in alignment with a tilting furnace in the horizontal position;

means for moving the rod in travel in the direction of its axis, the inside radius of the cross section of the shovel being at least equal to the semi-diameter of the charge, and its outside radius being less than the inside radius of the crucible, and means permitting the rod to rotate about its axis, in a manner such as to permit placement of the charge in the shovel, to cap the charge and the shovel by the crucible, and, once the shovel, charge, and crucible have been inserted in the furnace by axial movement of said rod, release the crucible and charge without substantial shock by rotating the shovel;

the rod being axially bored and having in its bore a slidable rectilinear lever appreciably longer than the rod permitting the lever to slide into the shovel, and means to momentarily hold the aforesaid lever in a fixed position in space in order to hold the charge and the crucible toward the back of the furnace as the shovel is extracted.

2. A device in accordance with claim 1, characterized by the fact that it includes as well means for imparting to the rod a vertical angular deflection movement about a horizontal axis perpendicular to the rod and at a distance from the shovel to the rear of the latter such that the shovel can lift the crucible slightly so as to insert it in the furnace without friction, or to extract it without friction.

3. In a vacuum smelting and tapping installation, of a type comprising, in a vacuum enclosure, a tilting smelting furnace with a removable cylindrical crucible, and a charging and discharging lock-chamber arranged horizontally in alignment with a tilting furnace in the horizontal position, characterized by the fact that it includes, in addition, a device for placing the charge conforming to any one of claim 1, and arranged at the outside of the enclosure opposite the lock-chamber and the furnace.

4. Installation in accordance with claim 3, characterized by the fact that the lock-chamber is comprised of a lock-chamber housing, the dimensions of which are sufficient to take the shovel, the charge, and the crucible, in communication via one of its ends with the enclosure through a cut-off gate and closed at the other end by an airtight collar guiding the rod.

5. Installation in accordance with claim 4, characterized by the fact that the lock-chamber housing is long enough to admit the charge placed in the shovel and the crucible placed in front of the shovel, and includes a lateral door for the introduction of the crucible, and for extraction of the crucible.

6. Installation in accordance with claim 3 or claim 4, characterized by the fact that the device includes means for imparting to the rod a vertical angular deflection movement about a horizontal axis perpendicular to the rod and at a distance from the shovel to the rear of the latter such that the shovel can lift the crucible slightly so as to insert it in the furnace without friction, or to extract it without friction and by the fact that the lock-chamber and the cut-off gate are connected to the enclosure by an expansion coupling, and by means that enable the lock-chamber to follow the vertical deflection of the rod.

* * * * *